US008865993B2

(12) United States Patent
Vorobyev et al.

(10) Patent No.: US 8,865,993 B2
(45) Date of Patent: Oct. 21, 2014

(54) MUSICAL COMPOSITION PROCESSING SYSTEM FOR PROCESSING MUSICAL COMPOSITION FOR ENERGY LEVEL AND RELATED METHODS

(71) Applicants: Yakov Vorobyev, Rockville, MD (US); Martin Douglas, Nr. Canterbury (GB)

(72) Inventors: Yakov Vorobyev, Rockville, MD (US); Martin Douglas, Nr. Canterbury (GB)

(73) Assignee: Mixed In Key LLC, Miami, FL (US)

( * ) Notice: Subject to any disclaimer, the term of this patent is extended or adjusted under 35 U.S.C. 154(b) by 0 days.

(21) Appl. No.: 13/774,410

(22) Filed: Feb. 22, 2013

(65) Prior Publication Data

US 2014/0123836 A1 May 8, 2014

Related U.S. Application Data

(60) Provisional application No. 61/721,897, filed on Nov. 2, 2012.

(51) Int. Cl.
*G10H 7/00* (2006.01)
*G10H 1/18* (2006.01)

(52) U.S. Cl.
CPC ..... *G10H 1/18* (2013.01)
USPC ..... 84/616

(58) Field of Classification Search
USPC ..... 84/616
See application file for complete search history.

(56) References Cited

U.S. PATENT DOCUMENTS

| | | | | |
|---|---|---|---|---|
| 7,220,911 | B2 | 5/2007 | Basu | |
| 7,386,357 | B2 | 6/2008 | Zhang | |
| 7,563,971 | B2 | 7/2009 | Padhi et al. | |
| 7,626,110 | B2 | 12/2009 | Padhi et al. | |
| 7,842,878 | B2 * | 11/2010 | Vorobyev | 84/616 |
| 8,013,230 | B2 | 9/2011 | Eggink | |
| 8,326,584 | B1 * | 12/2012 | Wells et al. | 703/2 |
| 2007/0163425 | A1 * | 7/2007 | Tsui et al. | 84/609 |
| 2009/0234649 | A1 * | 9/2009 | Goodhew | 704/243 |
| 2012/0092167 | A1 | 4/2012 | Hohl | |

* cited by examiner

*Primary Examiner* — Jeffrey Donels
(74) *Attorney, Agent, or Firm* — Oblon, Spivak, McClelland, Maier & Neustadt, L.L.P.

(57) ABSTRACT

A musical composition processing system may include a storage device for storing reference musical compositions, an energy level characteristic value for each reference musical composition, and an attribute profile for each reference musical composition, and a computing device in communication with the storage device and for processing an input musical composition. The processing of the input musical composition may include determining an attribute profile for the input musical composition based upon transient and ambient sounds in the input musical composition, and determining an energy level characteristic data value for the input musical composition by correlating the attribute profile of the input musical composition to the respective attribute profiles and the energy level characteristic data values of the reference musical compositions.

20 Claims, 3 Drawing Sheets

MUSICAL COMPOSITION PROCESSING SYSTEM FOR PROCESSING MUSICAL COMPOSITION FOR ENERGY LEVEL AND RELATED METHODS

RELATED APPLICATIONS

This application is based upon prior filed copending provisional application Ser. No. 61/721,897 filed Nov. 2, 2012, the entire subject matter of which is incorporated herein by reference in its entirety.

FIELD OF THE INVENTION

The present invention relates to the field of processing musical compositions, and, more particularly, to determining an energy level of a musical composition and related methods.

BACKGROUND

The ability to accurately determine energy level information from a musical composition represented, for example, in a digital audio file, has many applications. For example, it can be particularly useful for a DJ to know the overall energy level of a song, or how the energy level develops through the duration of a song. When creating a set, a DJ may aim to maintain a certain energy level by mixing songs that have a consistently high energy level. The DJ may also choose certain points in the mix to play lower energy level songs so that there is some variation in a mix, and to give listeners time to recover physically. In this scenario, it would be beneficial to have the ability to perform a search in a database of music based on the energy level of each song, to aid the selection of songs to play. Typically, documentation concerning the energy level of a musical composition is not available, and even when it is, there may be no consistent standard for describing the energy level of a musical composition.

The energy level for a database of musical compositions may be determined by a human listener, who would give a subjective rating level in the range 1 to 10, where 1 would represent a musical composition with a very low energy level and 10 would represent the highest energy level a song can have. However, this can be very time consuming, and for the best results, a single person would need to determine or verify the energy level of an entire database of musical compositions so that the relative energy levels between musical compositions are consistent.

Standard software algorithms exist for determining the loudness of a musical composition, or how dynamic a musical composition is in terms of loudness changes. This can, to some extent, be used to determine the energy level of a musical composition. Musical compositions that are quiet and/or less dynamic generally relate to low energy levels, whereas loud and/or highly dynamic musical compositions are generally high in energy. However, the accuracy of such methods may be limited. These methods may not take into account the many interrelated high level attributes of a musical composition, which result in the perceived energy level of a musical composition, such as tempo and the type and loudness of beat patterns used. It may also be difficult to map these values to a single value that describes the overall energy level of a musical composition. In addition, creating an algorithm that produces acceptable results for a wide range of genres may be challenging. Typically, an algorithm may only give reasonable results for a small subset of genres.

One approach is disclosed in U.S. Pat. No. 8,326,584 to Wells et al. This approach characterizes a musical composition based upon a group of numerical values, each based upon human perception (e.g. danceability). This approach is based upon manual human cataloging of a large database of musical compositions and leveraging the database to characterize a new musical composition.

SUMMARY

In view of the foregoing background, it is therefore an object of the present invention to provide a musical composition processing system that can readily accommodate different musical styles, take into account many high level attributes of a musical composition that contribute to the perceived energy level, and provide consistent energy level prediction values in terms of relative energy levels between pairs of musical compositions.

This and other objects, features, and advantages in accordance with the present invention are provided by a musical composition processing system that may comprise a storage device for storing a plurality of reference musical compositions, at least one energy level characteristic value for each reference musical composition, and an attribute profile for each reference musical composition, and a computing device in communication with the storage device and for processing an input musical composition. The processing of the input musical composition may include determining an attribute profile for the input musical composition based upon transient and ambient sounds in the input musical composition, and determining at least one energy level characteristic data value for the input musical composition by correlating the attribute profile of the input musical composition to the respective attribute profiles and the at least one energy level characteristic data values of the plurality of reference musical compositions. Advantageously, the musical composition processing system may readily provide an energy value for the input musical composition.

More specifically, the determining of the attribute profile for the input musical composition may further comprise converting the input musical composition into a frequency domain. The determining of the attribute profile for the input musical composition may further comprise normalizing a volume level of the input musical composition in the frequency domain.

In some embodiments, the determining of the attribute profile for the input musical composition may further comprise applying an acoustic hearing curve to the input musical composition in the frequency domain. The determining of the attribute profile for the input musical composition may further comprise detecting transient and ambient sounds in the input musical composition.

Moreover, the determining of the attribute profile for the input musical composition may further comprise determining a tempo value for the input musical composition by comparing beat locations for potential tempo values to the transient sounds in the input musical composition. The determining of the attribute profile for the input musical composition may further comprise determining an ambient sound table of values and a transient sound table of values based upon the tempo value.

For example, the attribute profile for the input musical composition may comprise an average beat strength value, an average beat events per segment value, and a beat pattern occurrence value based upon the ambient sound table of values and the transient sound table of values. In some embodiments, the processor may determine the at least one energy level characteristic value for each reference musical composition based upon a neural network learning machine. The determining of the attribute profile for the input musical composition may also comprise dividing the input musical composition into a plurality of frequency bands.

Another aspect is directed to a method for processing an input musical composition. The method may comprise using a processor and memory to access a database comprising a plurality of reference musical compositions, at least one energy level characteristic value for each reference musical composition, and an attribute profile for each reference musical composition, and to determine an attribute profile for the input musical composition based upon transient and ambient sounds in the input musical composition. The method may comprise using the processor and memory to determine at least one energy level characteristic data value for the input musical composition by correlating the attribute profile of the input musical composition to the respective attribute profiles and the at least one energy level characteristic data values of the plurality of reference musical compositions.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
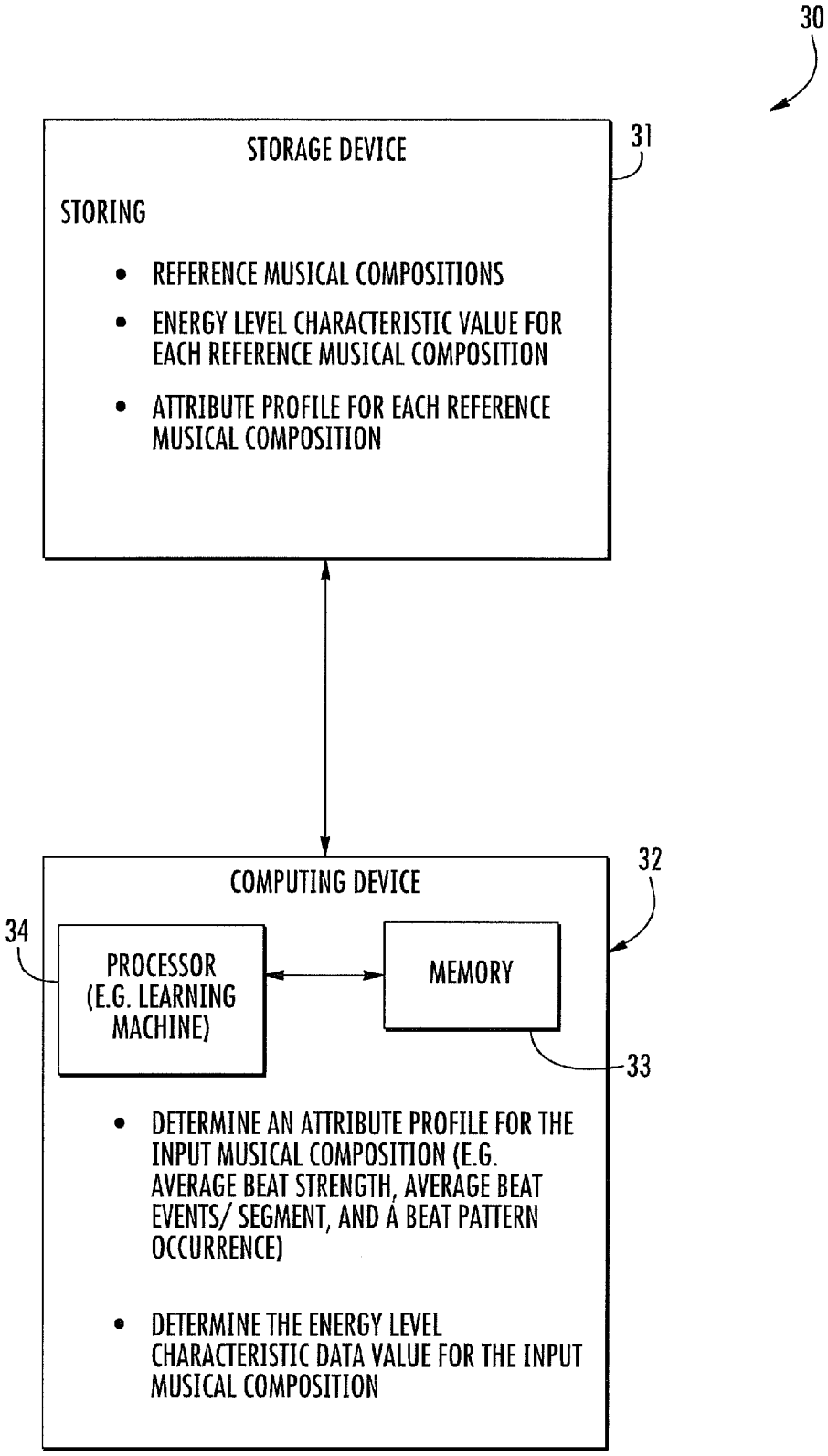
FIG. 1 is a musical composition processing system, according to the present invention.
Figure 2:
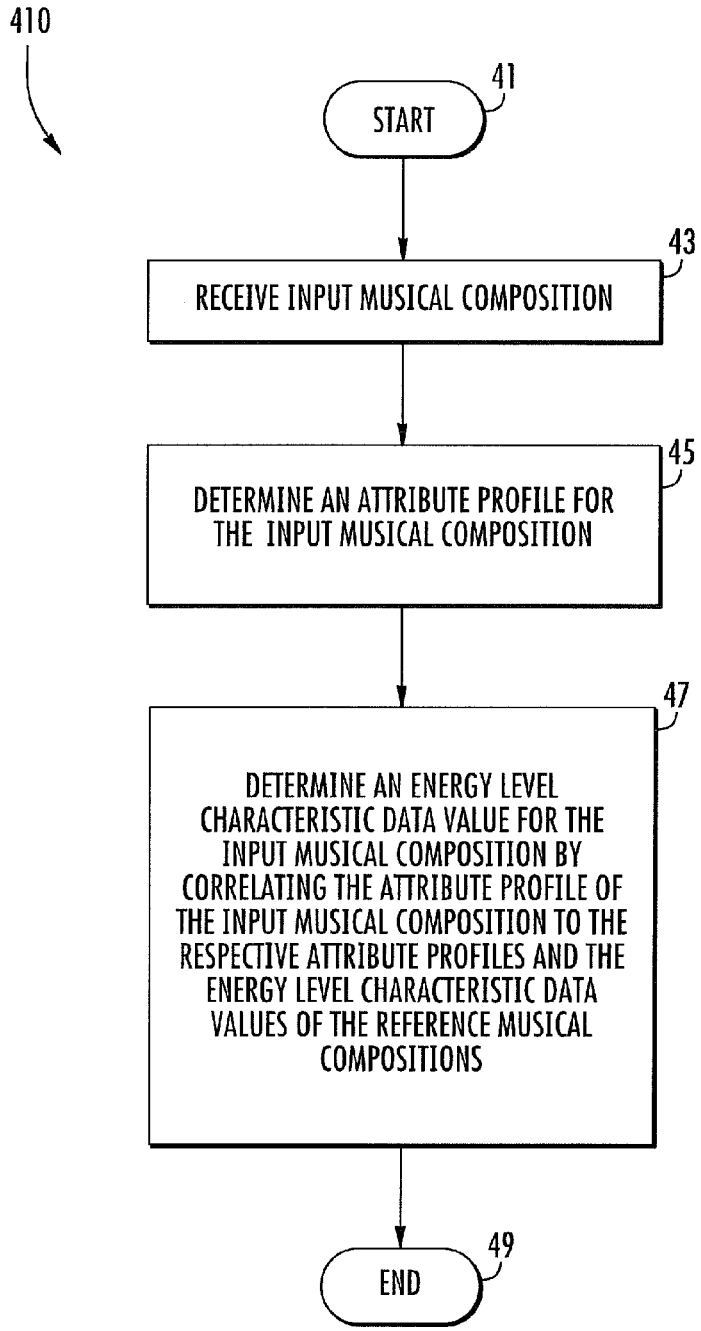
FIG. 2 is a flowchart illustrating operation of the musical composition processing system of FIG. 1.

Referring now to FIGS. 1-2, a musical composition processing system 30 according to the present invention is now described. Additionally, a flowchart 40 illustrates an associated method of operation and begins at Block 41. The musical composition processing system 30 includes a storage device 31 for storing a plurality of reference musical compositions, an energy level characteristic value for each reference musical composition, and an attribute profile for each reference musical composition. The energy level characteristic value is an estimate for the subjective danceability of the corresponding musical composition.

The musical composition processing system 30 includes a computing device 32 in communication with the storage device 31 and for processing an input musical composition (Block 43). The input musical composition has an unknown energy level characteristic value. The storage device 31 illustratively includes a processor 34, and a memory 33 cooperating therewith. In some embodiments, the computing device 32 and the storage device 31 are integrated into one physical computing device and housing. In other embodiments, the computing device 32 is remote to the storage device 31, perhaps communicating over the Internet (i.e. cloud based storage device 31) or some other form of wired/wireless networking.

The processing of the input musical composition includes determining an attribute profile for the input musical composition based upon transient and ambient sounds in the input musical composition (Block 45). For example, in some embodiments, the attribute profile for the input musical composition may comprise an average beat strength value, an average beat events per segment value, and a beat pattern occurrence value based upon the ambient sound table of values and the transient sound table of values. In other words, the attribute profile provides a detailed acoustic breakdown of the input musical composition.

More specifically, the determining of the attribute profile for the input musical composition may further comprise converting the input musical composition into a frequency domain (e.g. using a short-time Fourier transform (STFT)). The determining of the attribute profile for the input musical composition may further comprise normalizing a volume level of the input musical composition in the frequency domain. The determining of the attribute profile for the input musical composition may also comprise dividing the input musical composition into a plurality of frequency bands.

The determining of the attribute profile for the input musical composition may further comprise applying an acoustic hearing curve to the input musical composition in the frequency domain. The determining of the attribute profile for the input musical composition may further comprise detecting the transient and ambient sounds in the input musical composition.

Moreover, the determining of the attribute profile for the input musical composition may further comprise determining a tempo value for the input musical composition by comparing beat locations for potential tempo values to the transient sounds in the input musical composition. The determining of the attribute profile for the input musical composition may further comprise determining an ambient sound table of values and a transient sound table of values based upon the tempo value.

Once the attribute profile of the input musical composition has been determined, the processor 34 determines at least one energy level characteristic data value for the input musical composition by correlating the attribute profile of the input musical composition to the respective attribute profiles and the at least one energy level characteristic data values of the plurality of reference musical compositions (Blocks 47 & 49). In some embodiments, the processor 34 may determine the at least one energy level characteristic value for each reference musical composition based upon a neural network learning machine.

Another aspect is directed to a method for processing an input musical composition. The method may comprise using a processor 34 and memory 33 to access a database comprising a plurality of reference musical compositions, at least one energy level characteristic value for each reference musical composition, and an attribute profile for each reference musical composition, and to determine an attribute profile for the input musical composition. The method may comprise using the processor 34 and the memory 33 to determine at least one energy level characteristic data value for the input musical composition by correlating the attribute profile of the input musical composition to the respective attribute profiles and the at least one energy level characteristic data values of the plurality of reference musical compositions.

The present invention is a system and method for predicting and/or determining energy level information about a musical composition represented by an audio signal. The system includes a database having a collection of reference musical works. Each of the reference musical works is described by both an energy level value and an energy attribute profile. The energy level value represents how energetic a musical work is perceived by a human. The energy attribute profile describes various attributes of a musical work that are related to human perception of energy level, such as tempo and beat loudness in different frequency bands. Thus, for every reference musical work in the database, a corresponding energy level value and energy attribute profile exists. The energy level value and energy attribute profile may be determined through the same or different processes. For example, the energy level value may be determined by a neural network-based analysis of the reference musical work or by a skilled artisan with a trained ear listening to the song. The energy attribute profile may be determined by any number of software implemented algorithms. The database may include as many reference musical works as desired.

The present invention also provides an energy level estimation system coupled to the database, or, alternatively worded, capable of accessing the database. The energy level estimation includes an energy attribute algorithm, an association algorithm, and a target audio file input. The energy attribute algorithm operates to determine high level attributes of the target audio file or sections of the audio file related to the perceived energy content (the audio file or audio source containing the musical composition of interest). To avoid confusion, it should be noted that the structure/content of the energy attributes of the target audio file (i.e. musical composition) and the energy level attribute profile of the reference musical works are comparable. Further, in an embodiment, the energy attribute algorithm can also be used to determine the energy attribute profiles of the reference musical works. The target audio file input is an interface, whether hardware or software, adapted to accept/receive the target audio file to permit the energy level estimation system to analyze the target audio file (i.e. musical composition).

The association algorithm predicts energy level information about the target audio file given the energy attributes of the target audio file, and the information, i.e. reference musical works characteristics, in the database. Specifically, the association algorithm functions to predict energy level information based on an input, the energy level attributes of the target audio file, and the existing relationships defined in the database by the corresponding energy levels and reference musical energy attribute profiles and between different reference musical works. The association algorithm allows the energy level estimation system to generate implicit energy level information from the database given the energy attribute values calculated for a target audio file.

The association algorithm may comprise two main components, a data mining model and a prediction query. The data mining model is a combination of a machine learning algorithm and training data, e.g. the database of reference musical works. The data mining model is utilized to extract useful information and predict unknown values from a known data set (the database in the present instance). The major focus of a machine learning algorithm is to extract information from data automatically by computational and/or statistical methods. Examples of machine learning algorithms include Support Vector Machines, Decision Trees, Logistic Regression, Linear Regression, Naïve Bayes, Association, Neural Networks, and Clustering algorithms/methods. The prediction query leverages the data mining model to predict the energy level information based on the attributes of the target audio file.

Typically, the energy level in a musical work varies from start to finish. It is within the scope of the present invention to work with sections of a musical work rather than the musical work as a whole, when populating the database with energy attributes and their corresponding energy level value. Sections of reference musical works can be selected either manually or automatically, and the energy level and energy attribute profile for each section are determined and entered into the database as described previously for an entire musical work. Correspondingly, when predicting the energy level information of a target audio file, the target audio file can be split into multiple sections and the energy level prediction query applied to each section using energy attributes calculated for each section. This results in multiple energy level values for a single audio file. A single overall energy level value can be determined using methods of varying complexity, for example the median or average energy level value can be calculated, or the energy level value which lies at the 75th percentile so that sections of the target audio file which have a low energy are mostly ignored, i.e. the intro, outro or breakdown.

One important aspect of the present invention is the ability to have a database with reference musical works described by both an energy level value and an energy attribute profile. This provides the association algorithm with a database having multiple metrics describing a single reference musical work from which to base predictions. However, the importance lies not only in this multiple metric aspect but also in a database that can be populated with a limitless number of reference audio file segments from any styles or genres of music. In essence, the robust database provides a platform from which the association algorithm can base energy level information predictions. This engenders the present invention with an energy level prediction accuracy not seen in the prior art.

Figure 3:
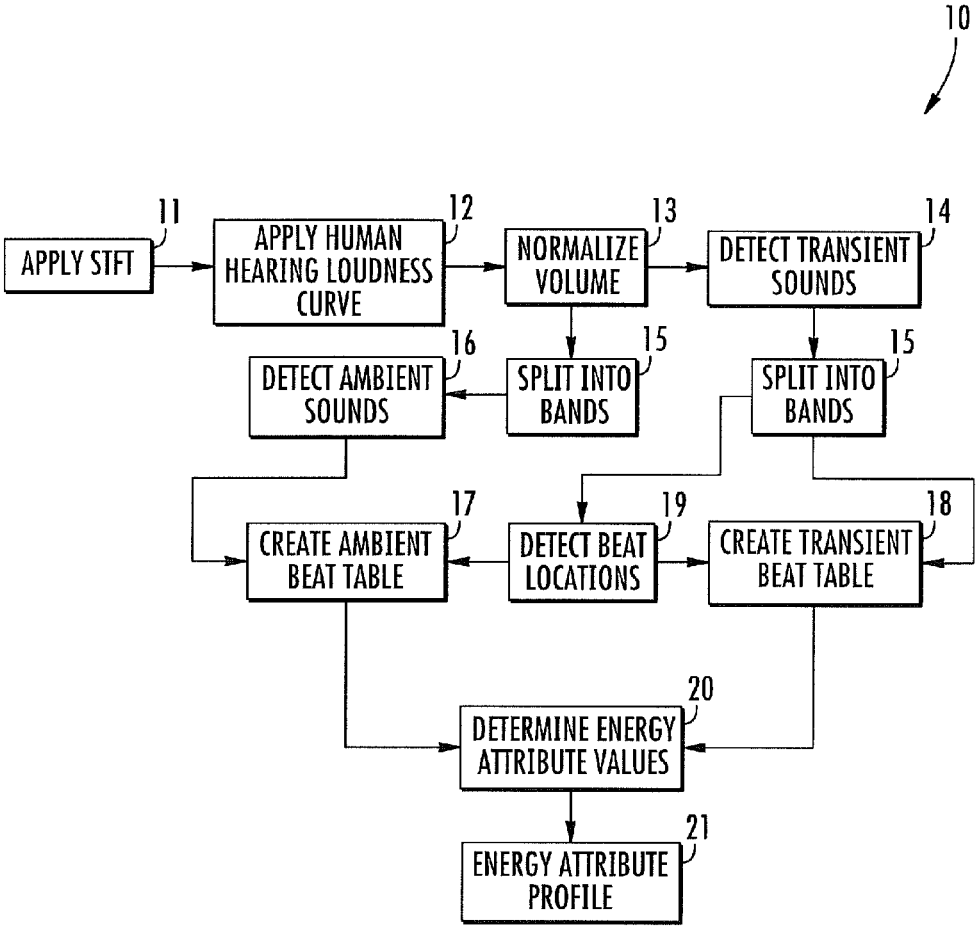
FIG. 3 is a flowchart illustrating generation of an energy attribute profile from an input musical composition, according to another embodiment of the present invention.

Referring now additionally to FIG. 3, another embodiment of the musical composition processing system 30 is now described. The present invention relates generally to analyzing musical compositions represented in audio files. More specifically, the present invention relates to predicting and/or determining the perceived energy level of a musical composition based on attributes of the composition in relation to a database of reference musical works, each reference musical work having an attribute profile and an energy level value. The attributes used are related to the perceived energy level of a musical composition. A musical work or composition describes lyrics, music, and/or any type of audible sound.

In one embodiment, the present invention provides an energy level estimation system coupled or having access to a database or training database. The energy estimation system includes an association algorithm, an energy attribute algorithm, and an audio file input. The audio file input permits the energy estimation system to access or receive the target audio file, the target audio file containing/representing the musical composition of interest (the composition for which energy level information is desired, hereinafter "musical composition"). The target audio file can be of any format, such as WAV, MP3 etc. (regardless of the particular medium storing/transferring the file, e.g. CD, DVD, hard drive, etc.). The audio file input may be a piece of hardware; such as a USB port, a CD/DVD drive, an Ethernet card, etc., it may be implemented via software, or it may be a combination of both hardware and software components. Regardless of the particular implementation, the audio file input permits the energy level estimation system to accept/access the musical composition.

The energy attribute algorithm is used to determine the energy level of the musical composition and, as will be explained in more detail below, provides a description of the musical composition from which the predicted energy level may be based. The energy attribute algorithm generates a list of values from a musical composition, which may include but are not limited to, the overall tempo of the composition in beats per minute, the average strength and number of beat events per segment of the composition, and the number of occurrences of certain beat patterns.

In an embodiment of the present invention, the energy attribute algorithm calculates the average tempo of the musical composition in beats per minute, in addition to the following values for a plurality of frequency bands:

1. The average loudness of transient sounds that are aligned to ¼ of a beat, these are defined as sounds which have a rapidly increasing volume over time.
2. The average number of prominent transients sounds occurring at intervals of ¼ of a beat, per segment. In this embodiment, the length of a segment is equal to 32 beats, using the detected tempo.
3. The average loudness of non-transient or ambient sounds, these are defined as sounds which increase or decrease slowly in volume over time.
4. The average number of times a prominent transient is followed by another prominent transient 'n' beats later per segment, where n is ¼, ½ and 1.
5. The average loudness of transients that aren't aligned to ¼ of a beat, corresponding to transients which do not follow a regular beat pattern.
6. The average loudness of ambient sounds that are aligned to ¼ of a beat, and the average loudness of ambient sounds that aren't aligned to ¼ of a beat.

In an embodiment of the present invention, 14 frequency bands are used for analyzing the transient and ambient sounds, the boundaries of which are 0 Hz, 75 Hz, 125 Hz, 180 Hz, 250 Hz, 375 Hz, 500 Hz, 800 Hz, 1200 Hz, 1800 Hz, 2500 Hz, 3700 Hz, 5000 Hz, 7000 Hz, 13000 Hz. The resulting attribute values are an abstract description of the number and loudness of the onset of different instruments which occupy certain frequency bands, such as bass drum and hi-hat, and how much those onsets follow a regular pattern which a listener would associate with energy level of a musical composition. In addition, the volume of slow changing sounds are described, as this also contributes to the perceived energy level of a musical composition.

It is within the scope of the present invention to use fewer or more than the specified 14 frequency bands when calculating the energy attributes, such as if the processing/speed concerns dictate that not all the frequency bands can be calculated, or that increasing the number of bands results in an acceptable trade off between speed and prediction quality. Also, the frequency bands can occupy any frequency ranges, and do not necessarily have to be non-overlapping or increase in a monotonic fashion. In addition, the energy attribute algorithm can produce a subset or a variation of the attributes listed above in an embodiment, and may produce other attributes based on many different features of a musical composition such as length of transient sounds or tonal content.

The energy attribute values can be calculated in numerous ways, one implementation of the energy attribute algorithm as illustrated in FIG. 3 (flowchart 10), relies on extracting and examining the absolute loudness and the derivative of loudness in respect to time at regular discrete points in the musical composition, for each frequency band to be analyzed. This can be achieved by converting the audio signal of the musical composition to the frequency domain by applying the STFT 11 to the audio signal. In an embodiment, the STFT is applied using a Hanning window of size 2048 samples and a hop size of 682 samples, with an audio signal sample rate of 44100 Hz. A shorter transform window or larger hop size may be used, or the audio signal may be downsampled prior to applying the STFT, if processing time is limited and the resulting prediction error is within an acceptable range for the application. In contrast, a larger transform window or a shorter hop size may be used, if decreasing prediction error is deemed more important than processing time.

Once the STFT has been applied to the audio signal, the resulting array of complex values for each frequency bin are converted to real values by calculating the magnitude of each complex value, producing an array containing the magnitude of each frequency. To make the magnitude values better match the perceived loudness of each frequency, a human hearing loudness curve may be applied 12 such as A-weighting or a Fletcher-Munson curve.

A volume normalization algorithm 13 may optionally be performed on the audio signal as a pre-processing step. This helps to avoid penalizing musical compositions which have been mastered at a quieter volume level compared to other musical compositions. One way of implementing this would be to determine the overall loudness of the musical composition as a value specified in linear units, and scaling the audio signal by the inverse of this loudness value. In an embodiment, the overall loudness is calculated by determining the RMS (root mean square) value of frequency loudness values for each STFT result, then retrieving the 95th percentile value from the resulting RMS loudness values. This is so that the loudest parts of the musical composition are used to determine the scaling factor used for normalization.

The result of applying the STFT to the audio signal at regular discrete points in time then converting the resulting values to loudness values, is a 2-dimensional array of values that accurately representing the musical composition in terms of the loudness of frequencies throughout the musical composition. This can be visualized as a 2-dimensional spectrogram image, with time progressing horizontally and frequency vertically, and each pixel brightness representing the loudness at the corresponding this embodiment and time. Using the STFT parameters specified in the embodiment, this would be an image with a height of 1024 and width dependent on the duration of the musical composition. The frequencies along the vertical axis would start at 0 Hz and increase in steps of approximately 21.5 Hz, and the time along the horizontal axis would increase in steps of approximately 15 ms.

To determine the loudness and position of transient sounds 14 necessary for the energy attribute algorithm, two processing steps are applied to the spectrogram. The first step is to remove tonal sounds by applying a median filter vertically on the spectrogram. In one embodiment, a variable length median filter is used, starting at a length of 1 (no effect) at frequency bin 0, and increasing by 2 for each frequency increment up to a maximum of 19. This step can be skipped or the maximum median filter length can be reduced if processing time is a concern. The second step is to apply a horizontal filter to the spectrogram with a kernel [−1, 1], setting any negative values to zero. This step approximates the derivative of loudness in respect to time for each frequency. Isolated peaks over time correspond to the onset of transient sounds, which in turn indicate the start of percussive instruments in the musical composition such as hi-hat and bass drum. This resulting spectrogram will be referred to as the transient spectrogram.

The frequency band boundaries that are required for calculating the final energy attribute values do not necessarily match the constant size frequency bands produced by the STFT. In the case of some embodiments, the normal spectrogram and the transient spectrogram are to be transformed so that the 1024 STFT frequency bands are reduced to 14 energy attribute frequency bands. This may be accomplished in various ways, one method 15 is to determine which STFT frequency bands are covered by the energy attribute frequency bands, and calculate the sum of loudness values for those bands. If the edge of an energy attribute frequency band partially covers a STFT frequency band, it may be summed if the coverage is greater than 50%, or the value may be weighted by the amount of coverage.

Another method may be to sum the loudness values for each energy attribute frequency band using a weighting function, such that the weighting is highest at the center frequency of the band being calculated, and reduces to zero at the center frequency of neighboring bands. It is within the scope of the present invention to use any weighting function or method to reduce the STFT frequency bands down to the frequency bands used for calculating the final energy attribute values.

At this point, a pair of 2-dimensional arrays has been created, one describing the loudness of each frequency band at discrete points in the musical composition, the other describing the loudness of transient sounds of each frequency band at discrete points in the musical composition. The frequency bands represented in these arrays are those which will be used in the final energy attribute values. These frequency bands are non-linear, as opposed to those produced by the STFT. As a result, they better model the non-linear critical bands in human psychoacoustics which increase in bandwidth as frequency increases. These arrays will be referred to as the critical band spectrogram and the transient critical band spectrogram.

The critical band spectrogram is transformed 16 to produce an ambient critical band spectrogram, by filtering out transient sounds represented by peaks along the time axis. This can be accomplished using many methods, one of which is to apply a median filter along the time axis. In some embodiments, a median filter of size 13 is used. If processing time is a concern, a smaller filter size may be used, or a more computationally efficient method employed. Acceptable results may even be obtained by skipped the filtering process and using the normal critical band spectrogram to represent ambient sounds.

Additional optional processing steps may be applied to the transient critical band spectrogram, in order to improve the quality of the results of analysis steps applied later on. The first step is to apply a smoothing filter along the time axis; this will improve the accuracy of calculating the magnitude of detected peaks. In some embodiments, a filter with kernel [0.25, 0.5, 0.25] is used. Another step is to reduce spurious peaks caused by non-transient sounds such as noise. This may be accomplished by subtracting a small amount of the ambient critical band spectrogram from the transient critical band spectrogram, and setting any resulting negative values to zero. In some embodiments, 20% of the ambient critical band spectrogram is used. It is within the scope of the present invention to use any parameters or methods to improve the quality of the transient critical band spectrogram, with the aim of having distinct peaks in the spectrogram which represent the loudness of audible transient onsets in each frequency band of the musical composition.

As previously specified, in some embodiments of the present invention, the energy attribute algorithm calculates transient and ambient sound properties located at regular beat positions determined by the tempo of the musical composition. Although the energy attributes values can be calculated in numerous ways, one implementation involves generating transient 18 and ambient 17 critical band spectrograms where the loudness values at every ⅛ of a beat are stored. In these beat aligned spectrograms, the values at even indices starting at zero would correspond to the loudness at ¼ of a beat, which is typically the shortest interval between onsets of transient sounds in a musical composition. The values at odd indices would correspond to the loudness in-between typical transient sounds, for musical compositions with a regular rhythm these values are low when compared with the values at even indices in the transient spectrogram. The beat aligned critical band spectrograms will be referred to as the transient beat table and ambient beat table.

To create the beat tables 17, 18, the location of each beat in the musical composition must be determined 19. These locations are often referred to as a beat grid, the locations are equally spaced out as determined by the tempo of the musical composition, and they generally coincide with the location of transients. The beat grid can be calculated in various ways. Typically, the musical composition is deconstructed into a series of transient magnitudes and time positions.

A range of hypothetical tempos are compared to the series of transients, and a score is given according to how well each tempo matches the frequency of transients. The tempo with the best score is chosen, and the beat grid is created accordingly, ensuring that the phase of the beat grid is maximally aligned with the transients in the musical composition. It is within the scope of the present invention to use any algorithms or methods to determine the beat grid, including using autocorrelation to determine the tempo. Additionally, the tempo may change throughout the musical composition; this can be taken into account by continually recalculating the beat grid at multiple points in the musical composition.

Once the beat locations have been calculated 19, the locations of every ⅛ of a beat are calculated using interpolation between the existing beat locations. In this case, linear interpolation is likely to suffice as the tempo of a musical composition is unlikely to change significantly between consecutive beats, but any interpolation may be used. The loudness values at these ⅛ beat locations for the transient and ambient critical band spectrograms are calculated and stored in the transient 18 and ambient beat tables 17. The ⅛ beat locations will not generally coincide exactly with integral positions in the spectrograms, so it may be preferable to use interpolation in order to improve the quality of the resulting beat table values. In some embodiments, bicubic interpolation is used so that the loudness value accuracy is improved in the case where the peak loudness value lies between two sampled values in a spectrogram. It may also be advantageous, but optional, to adjust the beat locations slightly for each frequency band to maximize the values calculated for each beat in the transient beat table. This can improve the values, as it takes into account the fact that some instruments in a musical composition may start at slightly different times when compared to other instruments that reside in a different part of the audio spectrum.

The resulting transient and ambient beat tables can be used in the energy attribute algorithm to calculate values 20 for each frequency band that are related to the energy level of a musical composition, such as those previously specified in described embodiments, thereby producing the energy attribute profile 21 for a musical composition. One such attribute value is the average loudness of transient sounds occurring at intervals of ¼ of a beat. Among other methods, this may be calculated by determining the 90th percentile value of all values located at even indices for a frequency band in the transient beat table. Loudness of transient sound that are not aligned to ¼ of a beat may be calculated using the same method, but by looking at values located at odd indices. Another attribute value is the average number of prominent transients per segment occurring at intervals of ¼ of a beat. This may be calculated by counting the number of values located at even indices in the transient beat table that are larger than 50% of the average loudness of transient sounds for a frequency band, then dividing the result by the number of segments described in the beat table. In some embodiments, a segment is specified as consisting of 32 beats, so the number of segments would be calculated as the size of the beat table divided by 256.

Another attribute value which may be produced by the energy attribute algorithm is the average loudness of ambient sounds for each frequency band. This may be calculated by calculating the mean of the values in the ambient beat table for each frequency band. This can be extended to determine the loudness of ambient sounds that are aligned to ¼ of a beat, or that are not aligned to ¼ of a beat, by calculating the mean of values located at even indices or odd indices respectively.

In order to calculate the number of times a prominent transient is followed by another prominent transient 'n' beats later, among other methods, the transient beat table may be transformed using the following formula:

$$B'[i,j]=sqrt(B[i,j]*B[i+n*8,j])$$

B is the original beat table, B' is the resulting transformed beat table, i is the index in the beat table corresponding to increments of ⅛ of a beat, and j is the frequency band index. The resulting beat table contains large values where there is a transient sound followed by a transient sound 'n' beats later. The number of occurrences of this happening with prominent transients can be calculated for each frequency band by determining the 90th percentile value of all values located at even indices for the resulting beat table in a frequency band, and counting the number of values at even indices that are greater than 50% of that value. In some embodiments of the current invention, this value is calculated for each frequency band and for values of n equal to ¼, ½ and 1.

The database includes a plurality of reference audio files (also referred to as analyzed audio signals), each reference audio file representing a musical work (also referred to as a musical piece or reference composition) and having an energy level value and an energy attribute profile 21 or reference energy attribute profile 21. The energy attribute profile 21 of a musical work is analogous to the energy attributes of the musical composition and, in some embodiments, is obtained via the energy attribute algorithm detailed above.

The energy level value represents how energetic a musical work is perceived by a human. The energy level value can be determined in numerous ways, such as by a neural engine after it has been trained by evaluating outcomes using predefined criteria and informing the engine as to which outcomes are correct based on the criteria, the conclusion of an artisan with a trained ear, the musician or composer of the work, etc. Consequently, and importantly, all musical works in the database are described by two disparate metrics—energy level value and energy attribute profile 21.

The database may be contained on a single storage device or distributed among many storage devices. Further, the database may simply describe a platform from which the plurality of reference files can be located or accessed, e.g. a directory. The plurality of reference files contained within the database may be altered at any time as new reference musical works or supplemental analyzed audio files are added, removed, updated, or re-classified.

The association algorithm predicts energy level information about the musical composition by analyzing the energy attribute values of the composition in relation to both the energy levels and energy attribute profiles 21 of the plurality of reference audio files (containing/representing the musical works). The association algorithm of one embodiment is comprised of two main components: a data mining model and a prediction query.

The data mining model uses the pre-defined relationships between the energy level values and the energy attribute profiles 21 and between different reference audio files to generate/predict energy level information based on previously undefined relationships, i.e. a relationship between the energy level of the musical composition and the reference audio files or musical works. To realize this ability, the data mining model relies on training data from the database, in the form of energy level values and energy attribute profiles 21, and a machine learning algorithm.

Machine learning is a subfield of artificial intelligence that is concerned with the design, analysis, implementation, and applications of algorithms that learn from experience, experience in the present invention is analogous to the database. Machine learning algorithms may, for example, be based on neural networks, decision trees, support vector machines, Bayesian networks, association rules, dimensionality reduction, etc. In some embodiments, the machine learning algorithm is based on a support vector machine model.

Although an entire musical composition can be analyzed to detect the energy level, the present invention also permits the musical composition to be analyzed in segments of varying size. In addition, the database can be populated with energy attribute profiles 21 and corresponding energy level values for segments of reference compositions rather than entire musical compositions. This can improve the accuracy of energy level prediction due to the fact that the energy attributes can vary considerably throughout a given musical composition. A single overall energy level prediction value can be determined from the resulting multiple energy level predictions using varying methods, for example the median or average energy level value can be calculated, or the energy level value which lies at the 75th percentile so that sections of the target audio file which have a low energy are mostly ignored, i.e. the intro, outro or breakdown. Further, as the present invention can analyze the musical composition in segments, it can also report energy level changes that occur during a composition. Thus, if the energy level of the musical composition changes from 4 to 7 as the musical intro progresses, the present invention can report the change and the specific segment in the composition where the change occurred.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A musical composition processing system comprising:

a storage device for storing a plurality of reference musical compositions, at least one energy level characteristic value for each reference musical composition, and an attribute profile for each reference musical composition; and a computing device in communication with said storage device and for processing an input musical composition by at least determining an attribute profile for the input musical composition based upon transient and ambient sounds in the input musical composition, and determining at least one energy level characteristic data value for the input musical composition by correlating the attribute profile of the input musical composition to the respective attribute profiles and the at least one energy level characteristic data values of said plurality of reference musical compositions.

2. The musical composition processing system of claim 1 wherein the determining of the attribute profile for the input musical composition comprises converting the input musical composition into a frequency domain.

3. The musical composition processing system of claim 2 wherein the determining of the attribute profile for the input musical composition comprises normalizing a volume level of the input musical composition in the frequency domain.

4. The musical composition processing system of claim 2 wherein the determining of the attribute profile for the input musical composition comprises applying an acoustic hearing curve to the input musical composition in the frequency domain.

5. The musical composition processing system of claim 2 wherein the determining of the attribute profile for the input musical composition comprises detecting the transient and ambient sounds in the input musical composition.

6. The musical composition processing system of claim 5 wherein the determining of the attribute profile for the input musical composition comprises determining a tempo value for the input musical composition by comparing beat locations for potential tempo values to the transient sounds in the input musical composition.

7. The musical composition processing system of claim 6 wherein the determining of the attribute profile for the input musical composition comprises determining an ambient sound table of values and a transient sound table of values based upon the tempo value.

8. The musical composition processing system of claim 7 wherein the determining of the attribute profile for the input musical composition comprises determining an average beat strength value, an average beat events per segment value, and a beat pattern occurrence value based upon the ambient sound table of values and the transient sound table of values.

9. The musical composition processing system of claim 1 wherein said processor determines the at least one energy level characteristic value for each reference musical composition based upon a neural network learning machine.

10. The musical composition processing system of claim 1 wherein the determining of the attribute profile for the input musical composition comprises dividing the input musical composition into a plurality of frequency bands.

11. A musical composition processing device communicating with a database comprising a plurality of reference musical compositions, at least one energy level characteristic value for each reference musical composition, and an attribute profile for each reference musical composition, the musical composition processing device comprising:

a processor and memory cooperating therewith for processing an input musical composition by at least determining an attribute profile for the input musical composition based upon transient and ambient sounds therein, and determining at least one energy level characteristic data value for the input musical composition by correlating the attribute profile of the input musical composition to the respective attribute profiles and the at least one energy level characteristic data values of said plurality of reference musical compositions.

12. The musical composition processing device of claim 11 wherein the determining of the attribute profile for the input musical composition comprises converting the input musical composition into a frequency domain.

13. The musical composition processing device of claim 12 wherein the determining of the attribute profile for the input musical composition comprises normalizing a volume level of the input musical composition in the frequency domain.

14. The musical composition processing device of claim 12 wherein the determining of the attribute profile for the input musical composition comprises applying an acoustic hearing curve to the input musical composition in the frequency domain.

15. The musical composition processing device of claim 12 wherein the determining of the attribute profile for the input musical composition comprises detecting the transient and ambient sounds in the input musical composition.

16. A method for processing an input musical composition comprising:

using a processor and memory to access a database comprising a plurality of reference musical compositions, at least one energy level characteristic value for each reference musical composition, and an attribute profile for each reference musical composition;

using the processor and memory to determine an attribute profile for the input musical composition based upon transient and ambient sounds in the input musical composition; and using the processor and memory to determine at least one energy level characteristic data value for the input musical composition by correlating the attribute profile of the input musical composition to the respective attribute profiles and the at least one energy level characteristic data values of the plurality of reference musical compositions.

17. The method of claim 16 wherein the determining of the attribute profile for the input musical composition comprises converting the input musical composition into a frequency domain.

18. The method of claim 17 wherein the determining of the attribute profile for the input musical composition comprises normalizing a volume level of the input musical composition in the frequency domain.

19. The method of claim 17 wherein the determining of the attribute profile for the input musical composition comprises applying an acoustic hearing curve to the input musical composition in the frequency domain.

20. The method of claim 17 wherein the determining of the attribute profile for the input musical composition comprises detecting the transient and ambient sounds in the input musical composition.

* * * * *